US012692584B2

(12) United States Patent
Garza-Martinez et al.

(10) Patent No.: US 12,692,584 B2
(45) Date of Patent: Jul. 28, 2026

(54) LOW ALLOY THIRD GENERATION ADVANCED HIGH STRENGTH STEEL AND PROCESS FOR MAKING

(71) Applicant: Cleveland-Cliffs Steel Properties Inc., Cleveland, OH (US)

(72) Inventors: Luis Gonzalo Garza-Martinez, Wyoming, OH (US); Erik James Pavlina, Lebanon, OH (US)

(73) Assignee: Cleveland-Cliffs Inc., Cleveland, OH (US)

( * ) Notice: Subject to any disclaimer, the term of this patent is extended or adjusted under 35 U.S.C. 154(b) by 70 days.

(21) Appl. No.: 16/371,901

(22) Filed: Apr. 1, 2019

(65) Prior Publication Data

US 2019/0300995 A1 Oct. 3, 2019

Related U.S. Application Data

(60) Provisional application No. 62/650,620, filed on Mar. 30, 2018.

(51) Int. Cl.
*C22C 38/58* (2006.01)
*C21D 6/00* (2006.01)
(Continued)

(52) U.S. Cl.
CPC ..... *C22C 38/58* (2013.01); *C21D 6/001* (2013.01); *C21D 6/004* (2013.01); *C21D 6/005* (2013.01);
(Continued)

(58) Field of Classification Search
CPC ..... C21D 1/44; C21D 6/001; C21D 6/004; C21D 6/005; C21D 6/008; C21D 8/0226; C21D 9/0081; C21D 9/46; C22C 38/04; C22C 38/58; C22C 38/02; C22C 38/06; C22C 38/08; C22C 38/12; C22C 38/34; C22C 38/44; C22C 38/48
See application file for complete search history.

(56) References Cited

U.S. PATENT DOCUMENTS 4,437,902 A * 3/1984 Pickens ..... C21D 8/0263 148/332
10,266,911 B2 * 4/2019 Hayashi ..... C22C 38/26
(Continued)

FOREIGN PATENT DOCUMENTS

CN 1985016 A 6/2007
CN 101151390 A 3/2008
(Continued)

OTHER PUBLICATIONS

International Search Report and Written Opinion dated May 24, 2019 for Application No. PCT/US2019/025198, 13 pages.

*Primary Examiner* — John A Hevey
(74) *Attorney, Agent, or Firm* — FBT Gibbons LLP

(57) ABSTRACT

Prior third generation advanced high strength steels can produce ingots and hot bands that have a tendency to develop cracks. It has been found that an addition to third generation advanced high strength steels of one or more of molybdenum in an amount up to 0.50 wt % and nickel in an amount up to 1.5 wt %, eliminates the cracks in ingots, and improves the appearance of hot bands. More specifically the new exemplary alloys have shown to improve the toughness of ingots, as well as hot bands.

17 Claims, 5 Drawing Sheets

(51) Int. Cl.

| | |
|---|---|
| ***C21D 8/0221*** | (2026.01) |
| ***C21D 9/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/34*** | (2006.01) |
| ***C22C 38/44*** | (2006.01) |
| ***C22C 38/48*** | (2006.01) |

(52) U.S. Cl.
CPC ..... *C21D 6/008* (2013.01); *C21D 8/0226* (2013.01); *C21D 9/0081* (2013.01); *C21D 9/46* (2013.01); *C22C 38/02* (2013.01); *C22C 38/04* (2013.01); *C22C 38/06* (2013.01); *C22C 38/08* (2013.01); *C22C 38/12* (2013.01); *C22C 38/34* (2013.01); *C22C 38/44* (2013.01); *C22C 38/48* (2013.01)

(56) References Cited

U.S. PATENT DOCUMENTS

| | | | | |
|---|---|---|---|---|
| 10,633,727 | B2 * | 4/2020 | Garza-Martinez | C21D 11/00 |
| 2014/0050941 | A1 * | 2/2014 | Kawasaki | B32B 15/012 428/653 |
| 2016/0340761 | A1 * | 11/2016 | Garza-Martinez | C21D 1/26 |
| 2017/0321294 | A1 * | 11/2017 | Arlazarov | C23C 2/28 |
| 2020/0087764 | A1 * | 3/2020 | Sano | C22C 38/58 |

FOREIGN PATENT DOCUMENTS

| | | | |
|---|---|---|---|
| CN | 101166843 | A | 4/2008 |
| CN | 101932746 | A | 12/2010 |
| CN | 102912219 | A | 2/2013 |
| CN | 103556048 | A | 2/2014 |
| CN | 104011242 | A | 8/2014 |
| CN | 103060678 | B | 4/2016 |
| CN | 106811678 | A | 6/2017 |
| EP | 3093359 | A1 | 11/2016 |
| WO | WO 2016/001889 | | 1/2016 |
| WO | WO 2016/187576 | | 11/2016 |

* cited by examiner

LOW ALLOY THIRD GENERATION ADVANCED HIGH STRENGTH STEEL AND PROCESS FOR MAKING

PRIORITY

This application claims priority to U.S. Provisional Application Ser. No. 62/650,620, entitled LOW ALLOY 3$^{RD}$ GENERATION ADVANCED HIGH STRENGTH STEEL AND PROCESS FOR MAKING, filed on Mar. 30, 2018, the disclosure of which is incorporated by reference herein.

BACKGROUND

The automotive industry continually seeks more cost-effective steels that are lighter for more fuel-efficient vehicles and stronger for enhanced crash-resistance, while still being formable. The steels being developed to meet these needs are generally known as third generation advanced high strength steels. The goal for these materials is to lower the cost compared to other advanced high strength steels by reducing the amount of expensive alloys in the compositions, while still improving both formability and strength.

Dual phase steels, considered a first generation advanced high strength steel, have a microstructure comprised of a combination of ferrite and martensite that results in a good strength-ductility ratio, where the ferrite provides ductility to the steel, and the martensite provides strength. One of the microstructures of third generation advanced high strength steels utilizes ferrite, martensite, and austenite (also referred to as retained austenite). In this three-phase microstructure, the austenite allows the steel to extend its plastic deformation further (or increase its tensile elongation percentage). When austenite is subjected to plastic deformation, it transforms to martensite and increases the overall strength of the steel.

Austenite stability is the resistance of austenite to transform to martensite when subjected to temperature, stress, or strain. Austenite stability is controlled by its composition. Elements like carbon, manganese, nickel, and molybdenum increase the stability of austenite. Silicon and aluminum are ferrite stabilizers. However, due to their effects on hardenability, the martensite start temperature (Ms), and carbide formation, Si and Al additions can increase the austenite stability also.

SUMMARY

Prior third generation advanced high strength steels can produce ingots and hot bands that have a tendency to develop cracks. It has been found that an addition to third generation advanced high strength steels of one or more of molybdenum in an amount up to 0.50 wt % and nickel in an amount up to 1.5 wt %, eliminates the cracks in ingots and in hot bands. More specifically, the new exemplary alloys have shown to improve the toughness of ingots as well as hot bands.

Embodiments of the present alloys comprise the following elements: 0.20 to 0.30 wt % carbon; 3.0 to 5.0 wt % manganese, preferably 3.0 to 4.0 wt % manganese; 0.5 to 2.5 wt % silicon, preferably 1.0 to 2.0 wt % silicon; 0.5 to 2.0 wt % aluminum, preferably 1.0 to 1.5 wt % aluminum; 0-0.5 wt % molybdenum, preferably 0.25 to 0.35 wt % molybdenum; 0-1.5 wt % nickel; 0-0.050 wt % niobium; 0-1.0 wt % chromium, preferably 0 to 0.65 wt % chromium; and the balance being iron and impurities associated with steelmaking.

In certain embodiments better properties were obtained when the amount of Si+Al was 3 wt % or less.

DETAILED DESCRIPTION

Figure 1:
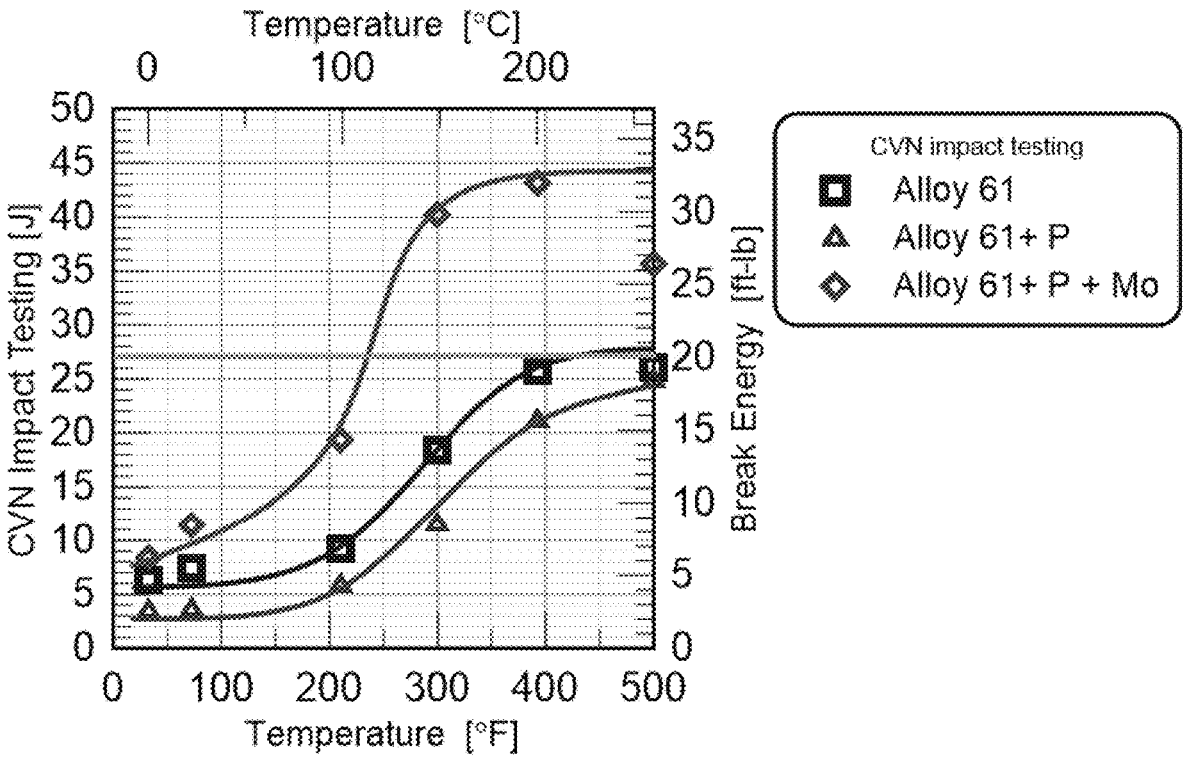
FIG. 1 depicts Charpy V-notched impact testing for Alloy 61, Alloy 61 with phosphorus addition, and Alloy 61 with phosphorus and molybdenum additions.

The present developments simplify processing of previous low alloy third generation advanced high strength steels, such as those alloys described in U.S. patent application Ser. No. 15/160,714, filed May 20, 2016, entitled "Low Alloy Third Generation Advanced High Strength Steel," the disclosure of which is incorporated herein by reference.

The present alloys allow the manufacturing of third generation advanced high strength steel using existing processing lines without the need of modifications to the equipment. The present alloys allow for standard processing, while preventing problems like lower toughness of steel in the slab and in the hot band state.

Prior third generation advanced high strength steels can produce ingots and hot bands that have a tendency to develop cracks. Once cracks are present in an ingot or slab, it is very difficult to process it without significant issues. Third generation advance high strength steels hot bands are extremely strong with tensile strengths well above 1000 MPa. The high strength of the hot bands combined with low or poor toughness makes them difficult to process, and sometimes impossible to process. It has been found that an addition to third generation advanced high strength steels of one or more of molybdenum in an amount up to 0.50 wt % and nickel in an amount up to 1.5 wt % eliminates the cracks in ingots, and improves the appearance of hot bands. More specifically the new exemplary alloys have shown to improve the toughness of ingots as well as hot bands.

Segregation of phosphorus to the grain boundaries in the steel can result in poor toughness. Phosphorus is present in steel as a residual element, and it is very costly to reduce it, and perhaps impossible to completely eliminate it. Besides phosphorus affecting the toughness behavior of the hot band, prior third generation advanced high strength steels can exhibit a natural poor toughness behavior because the steel in the quenched state has a body-centered tetrahedral crystal structure of martensite, and also in the annealed state where the microstructure is a body-centered cubic crystal structure of ferrite and carbides. In these two microstructures, the toughness behavior is temperature dependent. The toughness has an upper value called the upper shelf above a given temperature, and rapidly decreases with temperature all the way down to a lower value called the lower shelf. When the toughness decreases to the lower shelf, the steel behaves in a brittle manner.

The temperature at which the toughness drops to the lower shelf is referred as the ductile-to-brittle transition temperature (DBTT). Another practical definition of DBTT is the temperature at which the Charpy V-notch (CVN) impact energy is above 27 J, which is an impact energy where the steel does not generally behave in a brittle manner. The value of 27 J is typically used in industry to define DBTT. Sometimes the DBTT is above room temperature (RT), meaning that if the steel is tested at RT the steel behaves in a brittle manner.

The value of 27 J impact energy is considered for a full size CVN specimen with a thickness of 10 mm and depth under notch of 8 mm. When testing thinner specimens like with hot bands with a thickness under 10 mm, the impact strength is used for comparisons instead. The impact strength is calculated by dividing the impact energy by the sample's area (sample thickness multiplied by depth under notch). For example, for a specimen with a thickness of 10 mm (0.394") and a depth under notch of 8 mm (0.315"), and an impact energy of 27 J, the impact strength is: 27 J divided by 10 mm×8 mm, or in English units, a 20 ft/lbf divided by (0.394×0.315) in^2=1935 in-lbf/in^2. A sample with a of 3 mm thickness (0.118") and 8 mm (0.315") depth under notch, with the same impact strength of 1935 in-lbf/in^2 (equally as tough), the impact energy is lower however, about 6.0 ft-lbf or about 8.1 J.

Alloying elements like carbon, manganese, and silicon, among others, increases the DBTT, sometimes above RT. Nickel is one substitutional element which decreases the DBTT, improving the toughness of the steel for both crystal structures: body-centered tetrahedral (BCT), e.g., martensite, and body-centered cubic (BCC), e.g., ferrite.

A molybdenum addition to the steel improves the toughness of the steel in slab or ingot form by decreasing the DBTT and increasing the upper energy shelf. An example of this is shown in FIG. 1. In FIG. 1, CVN tests at various temperatures were performed on prior art Alloy 61 with no phosphorus (square symbols). The temperature at which the steel reaches 27 J is above 400° F. (204° C.). When the alloy contains phosphorus (triangles), the energy decreased for every case, and never reaches 27 J. When the Alloy 61 with phosphorus has molybdenum additions, the CVN impact energies increased at all test temperatures, showing lower DBTT under 250° F. (121° C.), and a higher upper energy shelf. The benefit of molybdenum translates to a tougher slab that is not likely to develop edge cracking around room temperature. By preventing defects on the slab, hot band defects are also prevented.

Nickel is an austenite stabilizer, similar to manganese. When nickel is added to the steel, the amount of manganese in the steel can be lowered, and still have the same austenite stability. By adding nickel and lowering manganese, the transformation temperatures are also affected. Si and Al concentrations can be modified, and still keep the transformation temperatures around the same temperatures as standard third generation advanced high strength steels. In other words, by adding nickel, the amount of manganese required can be reduced, which allows lower Si in the steel.

The reduction of Si positively affects the coatability of the steel. Silicon greatly complicates the coatability of steels by forming oxides during continuous annealing. These oxides can prevent Zn from wetting the steel, negatively affecting its coatability. A reduction of Si from 2.0 wt % to, for example, 1.0 wt % has the potential to improve the coating of the steel with Zn, allowing the coating to be carried out in existing coating lines without complex atmosphere manipulation.

Embodiments of the present alloys comprise the following elements: 0.20 to 0.30 wt % carbon; 3.0 to 5.0 wt % manganese, preferably 3.0 to 4.0 wt % manganese; 0.5 to 2.5 wt % silicon, preferably 1.0 to 2.0 wt % silicon; 0.5 to 2.0 wt % aluminum, preferably 1.0 to 1.5 wt % aluminum; 0-0.5 wt % molybdenum, preferably 0.25 to 0.35 wt % molybdenum; 0-1.5 wt % nickel; 0-0.050 wt % niobium; 0-1.0 wt % chromium, preferably 0 to 0.65 wt % chromium; and the balance being iron and impurities associated with steelmaking.

In certain embodiments better properties were obtained when the amount of Si+Al was 3 wt % or less.

The present alloys can be melted, cast, and hot rolled according to standard steelmaking practices using typical steel processing equipment at typical line speeds. Third generation advanced high strength steel hot bands, because of their alloying content, have microstructures that consist of mostly martensite, and so tend to be strong with yield strengths around 1000 MPa and low ductility.

The hot rolled steel (often called hot bands) often has a martensitic structure and so is hard, with low ductility. In order to cold reduce the hot bands, they need to be annealed and softened. The annealing process can be either continuous, as in a continuous annealing line, or done in a batch, as in box annealing. In some embodiments, the preferred method is a continuous annealing process.

If the steel is annealed in an annealing/pickling line, both processing steps are accomplished in a single operation. If the steel is batch annealed, the hot band can then be pickled and then cold rolled. The steel may be intermediately annealed after cold rolling and then further cold rolled. The cold rolled steel can then be coated, such as by hot dip galvanizing, hot dip galvannealing, hot dip aluminizing, or electrogalvanizing.

Improved tensile properties for embodiments of the present alloys can be obtained by intercritically annealing the embodiments of the steel. Intercritical annealing is taught in the above-referenced '714 application, which is incorporated herein by reference. Intercritical annealing is a heat treatment at a temperature where crystal structures of ferrite and austenite exist simultaneously. At intercritical temperatures above the carbide dissolution temperature, the carbon solubility of ferrite is minimal; meanwhile the solubility of carbon in the austenite is relatively high. The difference in solubility between the two phases has the effect of concentrating the carbon in the austenite. For example, if the bulk carbon composition of a steel is 0.25 wt %, if there exists 50% ferrite and 50% austenite, at the intercritical temperature the carbon concentration in the ferrite phase is close to 0 wt %, while the carbon in the austenite phase is now approximately 0.50 wt %. For the carbon enrichment of the austenite at the intercritical temperature to be optimal, the temperature should also be above the cementite ($Fe_3C$) or carbide dissolution temperature, i.e., the temperature at which cementite or carbide dissolves. This temperature will be referred to as the optimum intercritical temperature. The optimum intercritical temperature where the optimum ferrite/austenite content occurs is the temperature region above cementite ($Fe_3C$) dissolution and the temperature at which the carbon content in the resulting retained austenite at room temperature is maximized.

During intercritical annealing, other elements such as manganese, can also partition from ferrite to austenite. The amount of partitioning between the two phases depends on the time the steel is annealed at the intercritical annealing. For example, during a continuous annealing process, the amount of manganese or other substitution elements partition is lower than compared to a batch annealing process.

Example 1

Third Generation Advanced Strength Steel Hot Bands

Several alloys embodying the present invention were prepared with the compositions set forth in Table 1 below, with the balance being iron and impurities associated with steel making. Alloy 61 represents a prior art 3$^{rd}$ generation advanced high strength steels as taught in the above-referenced '714 application.

TABLE 1

Nominal chemical compositions of the alloys of the invention.

| Alloy | C | Mn | Al | Si | Ni | Mo | Cr | Nb | $M_s$ [° C.] Bulk |
|---|---|---|---|---|---|---|---|---|---|
| 61 | 0.25 | 4.0 | 1 | 2 | | | | 0.040 | 330 |
| 61 + Mo | 0.25 | 4.0 | 1 | 2 | | 0.3 | | 0.040 | 330 |
| 81 | 0.25 | 4.0 | 1.0 | 2.0 | 1.0 | 0.3 | | 0.040 | 330 |
| 82 | 0.25 | 3.5 | 1.0 | 2.0 | 1.0 | 0.3 | | 0.040 | 343 |
| 83 | 0.25 | 3.5 | 1.0 | 1.5 | 1.0 | 0.3 | | 0.040 | 357 |
| 84 | 0.25 | 3.5 | 1.5 | 1.0 | 1.0 | 0.3 | | 0.040 | 381 |
| 85 | 0.25 | 3.0 | 1.5 | 0.75 | 1.0 | 0.3 | 0.6 | 0.040 | 394 |
| 86 | 0.25 | 3.0 | 2.0 | 0.50 | 1.0 | 0.3 | 0.6 | 0.040 | 403 |

The alloys were melted and cast in the lab, using a vacuum furnace and typical steel making procedures. The ingots were fabricated to about 14 kgs in weight, with a width of around 127 mm and a thickness around 70 mm. The ingots were then hot rolled by reheating them in a furnace in air to a temperature of 1250° C. The ingots were hot rolled from a thickness of 70 mm to about 3 mm in 9 passes, with a reheat step in the middle. Some ingots were hot rolled from a thickness of 70 mm to about 12 mm for impact toughness testing. The finishing rolling temperature was about 900° C., and the bars were placed in a furnace set at 540° C. and slow cooled to simulate typical coiling cooling conditions. As shown in Table 2, the tensile properties of the hot bands were spectacular with yield strengths ranging from 746 to 948 MPa, and tensile strengths ranging from 1082 to 1526 MPa, and total elongations between 7.6 and 20.8.

TABLE 2

Mechanical tensile properties of alloy hot bands.

| ID | Thickness mm | Width mm | 0.5% Y.S. MPa | 0.2% off set Yield MPa | UTS MPa | 50.8 mm gauge length Elongation Measured % |
|---|---|---|---|---|---|---|
| 61 | 3.27 | 12.76 | 701 | 866 | 1383 | 10.3 |
| 61 + Mo | 2.18 | 13.06 | 696 | 948 | 1502 | 11.5 |
| 81 | 2.27 | 13.02 | 659 | 948 | 1526 | 7.6 |
| 82 | 2.27 | 12.97 | 699 | 897 | 1440 | 12.0 |
| 83 | 2.16 | 12.96 | 688 | 878 | 1404 | 10.6 |
| 84 | 3.20 | 12.74 | 754 | 852 | 1479 | 12.2 |
| 85 | 3.15 | 12.76 | 744 | 819 | 1426 | 12.3 |
| 86 | 3.18 | 12.76 | 704 | 788 | 1382 | 13.5 |

Figure 2:
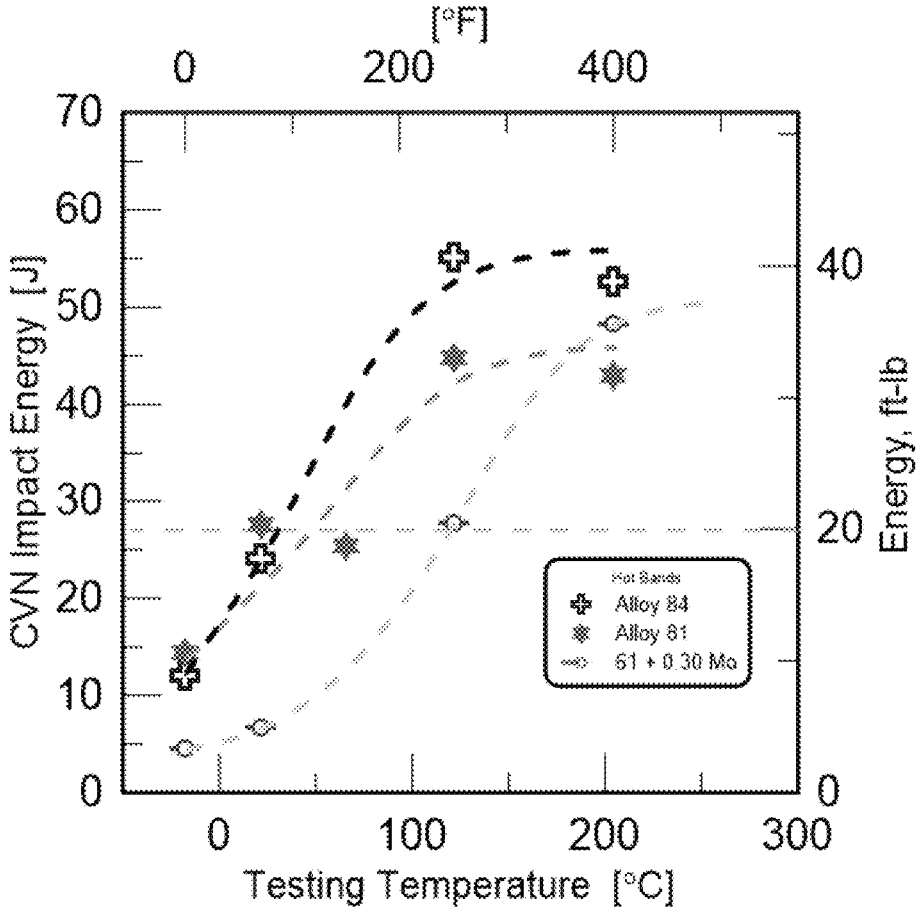
FIG. 2 depicts Charpy V-notched impact testing of Alloy 61+Mo, Alloy 81 and Alloy 84, at various temperatures.

The toughness behavior of the hot bands Alloy 61, Alloy 61+Mo, Alloy 81, Alloy 82, Alloy 83, and Alloy 84, was characterized and the results are presented in Table 3. This characterization was performed using full size CVN specimens with a 10 mm thickness. The Charpy V-notch impact testing was conducted, and the toughness at room temperature for Alloy 84 was 24 J, close to 27 J (20 ft-lbs) an impact testing energy at which the steel is no longer considered brittle. In comparison, in Alloy 61+Mo, the impact test energy was below 10 J at room temperature. Alloy 84 and Alloy 81 both have similar room temperature impact testing energies, however the upper shelf for Alloy 84 at higher temperatures is higher than that of Alloy 81. Other Alloy's hot bands also presented good toughness behavior when the hot bands were coiled at 900° F. (480° C.), such as Alloy 82 and Alloy 83. FIG. 2 presents the Charpy V-notched impact testing for Alloys 61, 61+Mo, 81 and 84. Alloy 84 with molybdenum and nickel additions, and Si+Al adjustment showed a higher upper energy shelf, and lower DBTT compared to Alloy 61+Mo. The results teach an addition of molybdenum, addition of nickel, and balance between manganese, nickel, and Si+Al result in a hot band with high toughness behavior that can be further processed at room temperature. The table below presents Charpy V-Notch impact testing energies for Alloys 61, 61+Mo, 81, 82, 83, and 84, for hot bands coiled at 900° F. (480° C.) and 1200° F. (650° C.).

Table 3 presents Charpy V-Notched impact testing energies for Alloys 61, 61+Mo, 81, 82, 83, and 84, for hot bands coiled at 900° F. (480° C.) and 1200° F. (650° C.).

TABLE 3

| Alloy | CT | Test Temp. (° F.) | Thickness (in) | D.U.N. (in) | Impact Energy (J) | Impact Energy (ft-lbf) | Impact Strength (W/A) (in-lbf/in^2) |
|---|---|---|---|---|---|---|---|
| 61 | 900 | 0 | 0.396 | 0.317 | 6.9 | 5.1 | 489 |
| 61 | 900 | 72 | 0.395 | 0.316 | 11.4 | 8.4 | 803 |
| 61 | 900 | 150 | 0.395 | 0.316 | 16.3 | 12.0 | 1155 |
| 61 | 900 | 250 | 0.395 | 0.316 | 43.9 | 32.4 | 3100 |
| 61 | 900 | 400 | 0.395 | 0.317 | 50.8 | 37.4 | 3595 |
| 61 | 1200 | 0 | 0.395 | 0.315 | 3.5 | 2.6 | 249 |
| 61 | 1200 | 72 | 0.396 | 0.316 | 4.4 | 3.3 | 315 |
| 61 | 1200 | 150 | 0.395 | 0.316 | 5.7 | 4.2 | 405 |
| 61 | 1200 | 250 | 0.395 | 0.317 | 13.4 | 9.9 | 951 |
| 61 | 1200 | 400 | 0.395 | 0.316 | 36.0 | 26.5 | 2540 |
| 61 + 0.30 Mo | 900 | 0 | 0.396 | 0.317 | 9.0 | 6.6 | 635 |
| 61 + 0.30 Mo | 900 | 72 | 0.395 | 0.317 | 16.4 | 12.1 | 1160 |
| 61 + 0.30 Mo | 900 | 150 | 0.396 | 0.316 | 25.4 | 18.8 | 1795 |
| 61 + 0.30 Mo | 900 | 250 | 0.395 | 0.317 | 43.6 | 32.2 | 3080 |
| 61 + 0.30 Mo | 900 | 400 | 0.396 | 0.315 | 46.2 | 34.1 | 3285 |
| 61 + 0.30 Mo | 1200 | 0 | 0.395 | 0.315 | 4.6 | 3.4 | 325 |

TABLE 3-continued

| Alloy | CT | Test Temp. (° F.) | Thickness (in) | D.U.N. (in) | Impact Energy (J) | Impact Energy (ft-lbf) | Impact Strength (W/A) (in-lbf/in^2) |
|---|---|---|---|---|---|---|---|
| 61 + 0.30 Mo | 1200 | 72 | 0.394 | 0.316 | 6.7 | 4.9 | 474 |
| 61 + 0.30 Mo | 1200 | 150 | 0.395 | 0.316 | 8.1 | 6.0 | 577 |
| 61 + 0.30 Mo | 1200 | 250 | 0.395 | 0.316 | 27.8 | 20.5 | 1970 |
| 61 + 0.30 Mo | 1200 | 400 | 0.395 | 0.315 | 48.4 | 35.7 | 3440 |
| 81 | 900 | 0 | 0.3954 | 0.31465 | 14.35 | 10.595 | 1024.5 |
| 81 | 900 | 72 | 0.3958 | 0.31545 | 27.55 | 20.35 | 1955 |
| 81 | 900 | 150 | 0.39575 | 0.3165 | 35.3 | 26.05 | 2495 |
| 81 | 900 | 250 | 0.3955 | 0.31685 | 44.7 | 33 | 3155 |
| 81 | 900 | 400 | 0.39535 | 0.3164 | 42.95 | 31.65 | 3040 |
| 81 | 1200 | 0 | 0.39535 | 0.3161 | 5.465 | 4.03 | 387 |
| 81 | 1200 | 72 | 0.39515 | 0.3166 | 11.3 | 8.33 | 799 |
| 81 | 1200 | 150 | 0.39535 | 0.3162 | 18.2 | 13.45 | 1290 |
| 81 | 1200 | 250 | 0.3954 | 0.3163 | 34.85 | 25.7 | 2465 |
| 81 | 1200 | 400 | 0.39505 | 0.3162 | 37.45 | 27.6 | 2655 |
| 82 | 900 | 0 | 0.3955 | 0.3164 | 12.95 | 9.54 | 915 |
| 82 | 900 | 72 | 0.3954 | 0.3161 | 20.8 | 15.35 | 1470 |
| 82 | 900 | 150 | 0.3953 | 0.31555 | 28.9 | 21.3 | 2050 |
| 82 | 900 | 250 | 0.3954 | 0.317 | 40.75 | 30.05 | 2875 |
| 82 | 900 | 400 | 0.39535 | 0.3159 | 46.85 | 34.55 | 3315 |
| 82 | 1200 | 0 | 0.39545 | 0.3164 | 5.99 | 4.42 | 424 |
| 82 | 1200 | 72 | 0.39475 | 0.3151 | 8.16 | 6.02 | 581 |
| 82 | 1200 | 150 | 0.39525 | 0.31645 | 13.45 | 9.91 | 950 |
| 82 | 1200 | 250 | 0.3957 | 0.3169 | 39.95 | 29.45 | 2815 |
| 82 | 1200 | 400 | 0.3943 | 0.31485 | 39.6 | 29.2 | 2820 |
| 83 | 900 | 0 | 0.39565 | 0.31505 | 13.37 | 9.875 | 950.5 |
| 83 | 900 | 72 | 0.3957 | 0.31595 | 25.95 | 19.1 | 1835 |
| 83 | 900 | 150 | 0.3956 | 0.3151 | 33.65 | 24.8 | 2390 |
| 83 | 900 | 250 | 0.3959 | 0.31685 | 41.9 | 30.9 | 2955 |
| 83 | 900 | 400 | 0.3958 | 0.3135 | 44.25 | 32.65 | 3160 |
| 83 | 1200 | 0 | 0.3956 | 0.3153 | 4.475 | 3.305 | 318 |
| 83 | 1200 | 72 | 0.39535 | 0.3152 | 7.055 | 5.205 | 501 |
| 83 | 1200 | 150 | 0.3952 | 0.3152 | 10.07 | 7.43 | 716 |
| 83 | 1200 | 250 | 0.39555 | 0.31695 | 32.2 | 23.75 | 2270 |
| 83 | 1200 | 400 | 0.39545 | 0.316 | 35.25 | 26 | 2495 |
| 84 | 900 | 0 | 0.39465 | 0.31605 | 12 | 8.845 | 850.5 |
| 84 | 900 | 72 | 0.39525 | 0.3168 | 24.15 | 17.8 | 1705 |
| 84 | 900 | 150 | 0.3952 | 0.3153 | 29 | 21.4 | 2060 |
| 84 | 900 | 250 | 0.39555 | 0.3159 | 55.05 | 40.55 | 3900 |
| 84 | 900 | 400 | 0.39495 | 0.317 | 52.6 | 38.75 | 3720 |
| 84 | 1200 | 0 | 0.39535 | 0.31765 | 6.81 | 5.02 | 480 |
| 84 | 1200 | 72 | 0.39565 | 0.3166 | 9.525 | 7.025 | 673 |
| 84 | 1200 | 150 | 0.39565 | 0.31615 | 14.2 | 10.465 | 1002 |
| 84 | 1200 | 250 | 0.39575 | 0.31665 | 39 | 28.75 | 2755 |
| 84 | 1200 | 400 | 0.3954 | 0.3156 | 58.6 | 43.2 | 4155 |

The hot bands were annealed in two ways, batch annealing, and continuously annealing. In both cases the annealing temperature was between 700-800° C., the intercritical region for the new alloys.

Example 2

Molybdenum Addition Ingot Toughness Improvement

FIG. 1 shows CVN impact testing of the ingots for Alloy 61, Alloy 61 with phosphorus addition, and Alloy 61 with phosphorus and molybdenum additions. One can see the improvement in toughness behavior of the ingots, of Alloy 61+Mo compared to Alloy 61 with no molybdenum. In one embodiment, FIG. 1 shows an increase of lower and upper shelves as well as a reduction of ductile to brittle transition temperature (DBTT) when the steel contains 0.30 wt % molybdenum. In the testing, the ingots were heat treated in a way to promote segregation of phosphorus to the grain boundaries, the main mechanism responsible for the poor toughness behavior. Charpy V-Notch specimens were prepared from the ingots, and tested at various temperatures as noted in FIG. 1.

Example 3

Batch Annealing Hot Band, Cold Rolling, and Finished Annealing.

Hot bands from Alloys 83, 84, 85, and 86 were batch annealed heat treated by heating the steel at around 740° C. at a rate of around 28° C./hour, soaking it at 740° C. for 4 hours, and cooling down to room temperature at around 28° C./hour. The annealed hot bands were then cold reduced about 50% for a thickness around 1.5 mm (with some variations). The now cold reduced strips were continuously annealed in a belt furnace (Lindberg belt furnace) in a range of temperatures from 700-760° C., all in an atmosphere of $N_2$, with a soaking time of around 3 minutes. This operation simulates a finishing annealing similar to what the steel experiences in a hot dip coating line, or in a continuous annealing line.

The tensile properties of the annealed steel for all Alloys are summarized in Table 4. Alloy 84, in particular, showed properties in the desired range for $3^{rd}$ generation AHSS, with a tensile strength-total elongation product of above 25,000 MPa*%, when the PMT was between 734-764° C. For the case of 752° C. PMT the YS of Alloy 84 was 739 MPa, YS of 1153 MPa, and T.E. of 30.5%. These remarkable properties are well above those expected for a third generation advanced high strength steels.

TABLE 4

Mechanical properties of batch annealed hot bands, cold rolled, and finished.

| Alloy | Width (mm) | Thickness (mm) | UYS (MPa) | LYS (MPa) | YPE (%) | 0.2% OYS (MPa) | UTS (MPa) | Total Elong. (Manual, in 2") (%) | TS*TE | PMT |
|---|---|---|---|---|---|---|---|---|---|---|
| 83 | 12.79 | 1.61 | 944 | 861 | 5.3 | 868 | 947 | 20.6 | 19514 | 697 |
| 83 | 12.78 | 1.60 | 912 | 835 | 4.9 | 841 | 991 | 24.7 | 24480 | 709 |
| 83 | 12.74 | 1.62 | 879 | 817 | 4.3 | 817 | 1043 | 28.0 | 29215 | 720 |
| 83 | 12.73 | 1.62 | 842 | 791 | 4.2 | 801 | 967 | 10.3 | 9957 | 734 |
| 83 | 12.73 | 1.65 | 831 | 769 | 3.6 | 780 | 1187 | 26.1 | 30986 | 737 |
| 83 | 12.75 | 1.66 | 614 | 611 | 1.7 | 617 | 908 | 3.7 | 3361 | 752 |
| 84 | 12.80 | 1.61 | 886 | 804 | 4.7 | 809 | 888 | 20.0 | 17750 | 697 |
| 84 | 12.73 | 1.64 | 876 | 791 | 3.9 | 797 | 902 | 22.3 | 20103 | 709 |
| 84 | 12.78 | 1.60 | 829 | 767 | 3.1 | 772 | 919 | 26.2 | 24088 | 720 |
| 84 | 12.76 | 1.59 | 770 | 745 | 2.5 | 743 | 972 | 31.3 | 30424 | 734 |
| 84 | 12.72 | 1.62 | 748 | 729 | 1.8 | 741 | 999 | 31.1 | 31063 | 737 |
| 84 | 12.74 | 1.64 | 739 | 728 | 2.0 | 739 | 1081 | 30.8 | 33282 | 749 |
| 84 | 12.75 | 1.59 | 722 | 703 | 2.8 | 717 | 1153 | 30.5 | 35176 | 752 |
| 84 | 12.75 | 1.63 | 673 | 647 | 2.2 | 644 | 1215 | 23.5 | 28545 | 764 |
| 85 | 12.78 | 1.62 | 751 | 692 | 4.3 | 700 | 789 | 18.3 | 14430 | 697 |
| 85 | 12.73 | 1.62 | 730 | 709 | 4.1 | 711 | 810 | 18.7 | 15151 | 709 |
| 85 | 12.80 | 1.61 | 743 | 683 | 4.2 | 684 | 805 | 22.4 | 18032 | 720 |
| 85 | 12.75 | 1.62 | 725 | 664 | 3.7 | 666 | 817 | 23.1 | 18866 | 734 |
| 85 | 12.72 | 1.65 | 705 | 643 | 2.7 | 646 | 850 | 20.1 | 17075 | 737 |
| 85 | 12.73 | 1.61 | 631 | 597 | 1.9 | 598 | 915 | 22.0 | 20119 | 749 |
| 85 | 12.79 | 1.61 | 571 | 549 | 1.7 | 548 | 961 | 23.9 | 22975 | 752 |
| 86 | 12.75 | 1.57 | 909 | 833 | 4.4 | 838 | 936 | 16.9 | 15818 | 709 |
| 86 | 12.77 | 1.69 | 901 | 825 | 4.0 | 828 | 963 | 15.9 | 15313 | 720 |
| 86 | 12.78 | 1.61 | 815 | 745 | 3.0 | 746 | 990 | 19.0 | 18802 | 734 |
| 86 | 12.72 | 1.59 | 710 | 659 | 2.5 | 661 | 1050 | 18.6 | 19536 | 737 |
| 86 | 12.74 | 1.59 | 621 | 597 | 2.1 | 609 | 1160 | 19.8 | 22958 | 749 |
| 86 | 12.72 | 1.73 | 597 | 584 | 1.9 | 589 | 1228 | 16.3 | 20013 | 752 |
| 86 | 12.73 | 1.55 | — | — | — | 349 | 1350 | 17.5 | 23622 | 764 |

Example 4

Continuous Annealing Hot Band, Cold Rolling, and Finished Annealing.

Hot bands from Alloys 61, 61+Mo, 81, 82, 83, 84, 85 and 86 were continuous annealed heat treated by heating the bands in a belt furnace (Lindberg) at a temperature of around 760° C. in an atmosphere of $N_2$ and a soaking time of around 3 minutes. The annealed hot bands were then cold reduced about 50% for a thickness around 1.5 mm (with some variations). The now cold reduced strips were continuously annealed in the same belt furnace (Lindberg belt furnace) in a range of temperatures from 700-770° C., all in an atmosphere of $N_2$, with a soaking time of around 3 minutes.

The tensile properties of the annealed steel in general showed properties in the desired range for 3$^{rd}$ generation AHSS, with a tensile strength-total elongation product of above 25,000 MPa*% for a broad range of PMTs. All tensile properties are summarized in Table 5. In particular Alloy 84 showed remarkable tensile strength-total elongation product of above 30,000 MPa*% for a broad range of PMTs between 709 to 752° C.

TABLE 5

Mechanical properties of continuous annealed hot bands, cold rolled, and finished.

| Alloy | Width (mm) | Thickness (mm) | UYS (MPa) | LYS (MPa) | YPE (%) | 0.2% OYS (MPa) | UTS (MPa) | Total Elong. Manual, in 2" (%) | Ts*TE | PMT |
|---|---|---|---|---|---|---|---|---|---|---|
| 61 | 12.75 | 1.11 | 884 | 847 | 4.7 | 860 | 942 | 18.3 | 17186 | 696 |
| 61 | 12.77 | 1.12 | 797 | 761 | 3.5 | 788 | 1003 | 19.3 | 19362 | 717 |
| 61 | 12.75 | 1.11 | 849 | 832 | 5.5 | 835 | 1079 | 28.5 | 30719 | 726 |
| 61 | 12.75 | 1.11 | 864 | 817 | 5.5 | 827 | 1109 | 30.5 | 33796 | 738 |
| 61 | 12.74 | 1.12 | 845 | 809 | 5.8 | 812 | 1177 | 30.1 | 35357 | 749 |
| 61 | 12.75 | 1.10 | 820 | 787 | 4.7 | 786 | 1223 | 27.2 | 33204 | 755 |
| 61 | 12.77 | 1.12 | 751 | 743 | 3.4 | 748 | 1262 | 18.9 | 23886 | 768 |
| 61 | 12.75 | 1.10 | — | — | — | 606 | 1165 | 13.4 | 15585 | 781 |
| 61 + Mo | 12.73 | 1.09 | 866 | 855 | 4.0 | 862 | 968 | 15.6 | 15131 | 696 |
| 62 + Mo | 12.73 | 1.11 | 867 | 861 | 4.6 | 868 | 1085 | 25.7 | 27925 | 726 |
| 63 + Mo | 12.75 | 1.10 | 874 | 865 | 3.7 | 856 | 1039 | 18.8 | 19474 | 717 |
| 64 + Mo | 12.73 | 1.11 | 858 | 876 | 5.4 | 869 | 1125 | 31.1 | 35018 | 738 |
| 65 + Mo | 12.76 | 1.12 | 864 | 863 | 5.1 | 846 | 1187 | 31.1 | 36886 | 749 |
| 66 + Mo | 12.74 | 1.13 | 845 | 819 | 4.9 | 819 | 1262 | 27.4 | 34551 | 755 |
| 67 + Mo | 12.73 | 1.14 | 743 | 736 | 2.5 | 744 | 1351 | 20.6 | 27767 | 781 |
| 68 + Mo | 12.77 | 1.12 | 813 | 784 | 3.2 | 808 | 1304 | 23.1 | 30166 | 768 |

TABLE 5-continued

Mechanical properties of continuous annealed hot bands, cold rolled, and finished.

| Alloy | Width (mm) | Thickness (mm) | UYS (MPa) | LYS (MPa) | YPE (%) | 0.2% OYS (MPa) | UTS (MPa) | Total Elong. Manual, in 2" (%) | Ts*TE | PMT |
|---|---|---|---|---|---|---|---|---|---|---|
| 81 | 12.76 | 1.13 | 1169 | 1112 | 10.2 | 1127 | 1175 | 21.1 | 24828 | 696 |
| 81 | 12.76 | 1.13 | 1107 | 1077 | 10.7 | 1080 | 1182 | 35.2 | 41652 | 717 |
| 81 | 12.73 | 1.13 | 1106 | 1046 | 10.0 | 1058 | 1213 | 33.0 | 39958 | 726 |
| 81 | 12.80 | 1.13 | 1004 | 1000 | 8.4 | 1002 | 1258 | 32.0 | 40218 | 738 |
| 81 | 12.73 | 1.17 | 987 | 969 | 0.0 | 971 | 1320 | 27.9 | 36799 | 749 |
| 81 | 12.74 | 1.18 | 792 | 781 | 2.2 | 783 | 1442 | 19.6 | 28297 | 768 |
| 81 | 12.73 | 1.18 | — | — | — | 595 | 1510 | 18.6 | 28012 | 781 |
| 82 | 12.73 | 1.11 | 938 | 891 | 4.8 | 897 | 995 | 17.1 | 17001 | 696 |
| 82 | 12.76 | 1.10 | 932 | 896 | 4.3 | 908 | 1081 | 23.7 | 25600 | 717 |
| 82 | 12.79 | 1.11 | 914 | 907 | 3.9 | 911 | 1112 | 30.3 | 33721 | 726 |
| 82 | 12.79 | 1.11 | 906 | 892 | 5.6 | 896 | 1157 | 31.4 | 36330 | 738 |
| 82 | 12.73 | 1.17 | 886 | 843 | 4.9 | 845 | 1218 | 28.4 | 34577 | 749 |
| 82 | 12.76 | 1.16 | 837 | 812 | 4.1 | 810 | 1288 | 25.2 | 32434 | 755 |
| 82 | 12.75 | 1.16 | 772 | 742 | 2.7 | 742 | 1345 | 19.9 | 26796 | 768 |
| 82 | 12.75 | 1.16 | — | — | — | 588 | 1404 | 18.7 | 26229 | 781 |
| 83 | 12.75 | 1.18 | 995 | 967 | 6.2 | 967 | 1051 | 21.1 | 22149 | 696 |
| 83 | 12.75 | 1.16 | 945 | 940 | 7.1 | 937 | 1086 | 33.1 | 35966 | 717 |
| 83 | 12.79 | 1.15 | 931 | 891 | 6.8 | 901 | 1142 | 30.2 | 34425 | 726 |
| 83 | 12.77 | 1.17 | 942 | 867 | 5.4 | 867 | 1252 | 28.0 | 35099 | 738 |
| 83 | 12.75 | 1.15 | 842 | 830 | 3.8 | 837 | 1305 | 21.1 | 27474 | 749 |
| 83 | 12.74 | 1.15 | 748 | 744 | 2.5 | 747 | 1354 | 18.5 | 25051 | 755 |
| 83 | 12.73 | 1.18 | — | — | — | 482 | 1446 | 18.3 | 26384 | 768 |
| 83 | 12.74 | 1.19 | — | — | — | 464 | 1525 | 14.9 | 22685 | 781 |
| 84 | 12.79 | 1.52 | 1002 | 922 | 4.0 | 926 | 1034 | 17.5 | 18090 | 697 |
| 84 | 12.74 | 1.51 | 984 | 935 | 4.1 | 938 | 1070 | 23.9 | 25571 | 709 |
| 84 | 12.73 | 1.50 | 970 | 943 | 3.2 | 963 | 1091 | 30.6 | 33388 | 720 |
| 84 | 12.76 | 1.53 | 970 | 949 | 4.3 | 970 | 1130 | 37.6 | 42503 | 734 |
| 84 | 12.77 | 1.47 | 1016 | 994 | 4.0 | 1000 | 1164 | 32.6 | 37933 | 737 |
| 84 | 12.77 | 1.50 | 943 | 890 | 5.6 | 943 | 1223 | 32.9 | 40240 | 749 |
| 84 | 12.77 | 1.49 | 926 | 874 | 4.7 | 869 | 1276 | 30.7 | 39173 | 752 |
| 84 | 12.73 | 1.13 | 820 | 807 | 3.1 | 814 | 1262 | 15.0 | 18906 | 755 |
| 84 | 12.73 | 1.16 | 700 | 694 | 0.2 | 693 | 1378 | 18.6 | 25603 | 768 |
| 84 | 12.73 | 1.15 | — | — | — | 495 | 1433 | 17.8 | 25434 | 781 |
| 85 | 12.77 | 1.49 | 824 | 758 | 4.3 | 762 | 864 | 19.0 | 16422 | 697 |
| 85 | 12.75 | 1.49 | 793 | 736 | 4.4 | 740 | 846 | 19.6 | 16576 | 709 |
| 85 | 12.75 | 1.49 | 783 | 722 | 4.4 | 726 | 841 | 20.2 | 16988 | 720 |
| 85 | 12.75 | 1.47 | 779 | 702 | 3.7 | 704 | 860 | 21.1 | 18138 | 734 |
| 86 | 12.76 | 1.62 | 808 | 746 | 4.0 | 751 | 878 | 19.1 | 16776 | 709 |
| 86 | 12.74 | 1.66 | 816 | 750 | 3.9 | 755 | 894 | 19.4 | 17347 | 720 |
| 86 | 12.77 | 1.63 | 686 | 625 | 2.4 | 627 | 891 | 20.4 | 18183 | 734 |
| 86 | 12.73 | 1.63 | 720 | 668 | 2.6 | 669 | 986 | 21.6 | 21302 | 737 |
| 86 | 12.73 | 1.66 | 661 | 622 | 2.2 | 628 | 1115 | 21.4 | 23855 | 749 |
| 86 | 12.72 | 1.65 | 598 | 568 | 1.7 | 569 | 1227 | 19.8 | 24291 | 752 |
| 86 | 12.75 | 1.61 | — | — | — | 372 | 1320 | 19.0 | 25082 | 764 |

Figure 3:
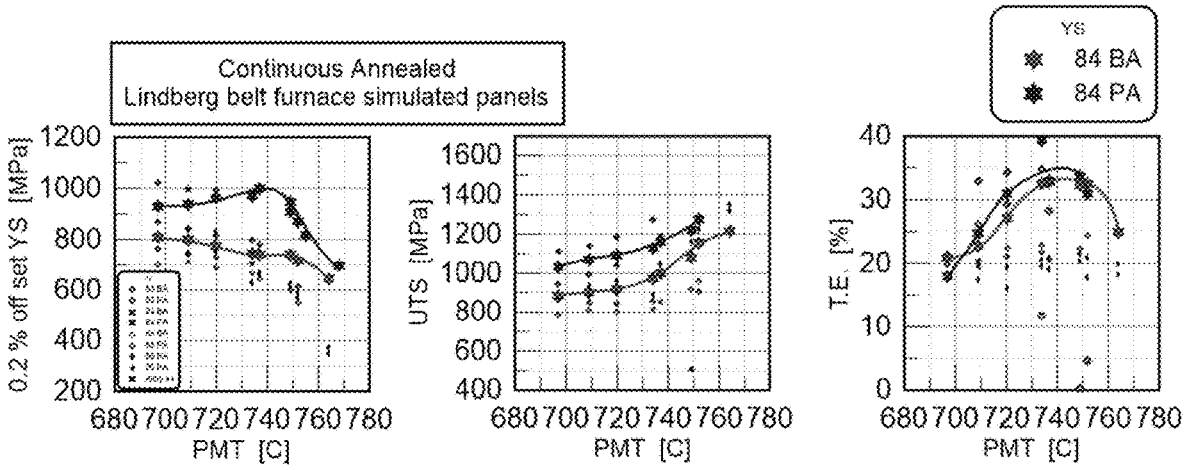
FIG. 3 depicts a summary of tensile mechanical properties of Alloy 83, Alloy 84, Alloy 85, and Alloy 86, hot band batch annealed (BA), hot band continuously annealed (PA), cold rolled, and finished annealed.

Alloy 84, in general, showed properties in the desired range for 3$^{rd}$ generation AHSS, with a tensile strength-total elongation product of above 35,000 MPa*%, for batch annealed hot bands, and for continuously annealed hot bands, in a broad range of PMTs. In FIG. 3, the tensile properties for Alloys 83, 84, 85, and 86, batch annealed and continuous annealed hot bands, are plotted. In this plot the properties for Alloy 84 are highlighted with larger symbols for comparison.

Alloy 84 is an example where the alloying content is well balanced for manganese, nickel, and Si+Al. The steel can be processed in a practical manner, i.e., using typical equipment and processing, due to the increase hot band toughness. The annealed band, either by batch annealing, or by continuous annealing, can be cold reduced. The finished steel can be annealed at a practical range of temperatures (e.g, 700-800° C.) in a continuous annealing process such as in a hot dip coating line (either Zn or Al coated), or in a continuous annealing line. The resulting mechanical tensile properties are well within the range of those represented by third generation advanced high strength steels, with a tensile strength-total elongation product above 30,000 MPa*%, and a high yield strength above 900 MPa.

Example 5

Alloy 84 Annealed Hot Band, Cold Reduced, and Finished Annealed Microstructure

Figure 4:
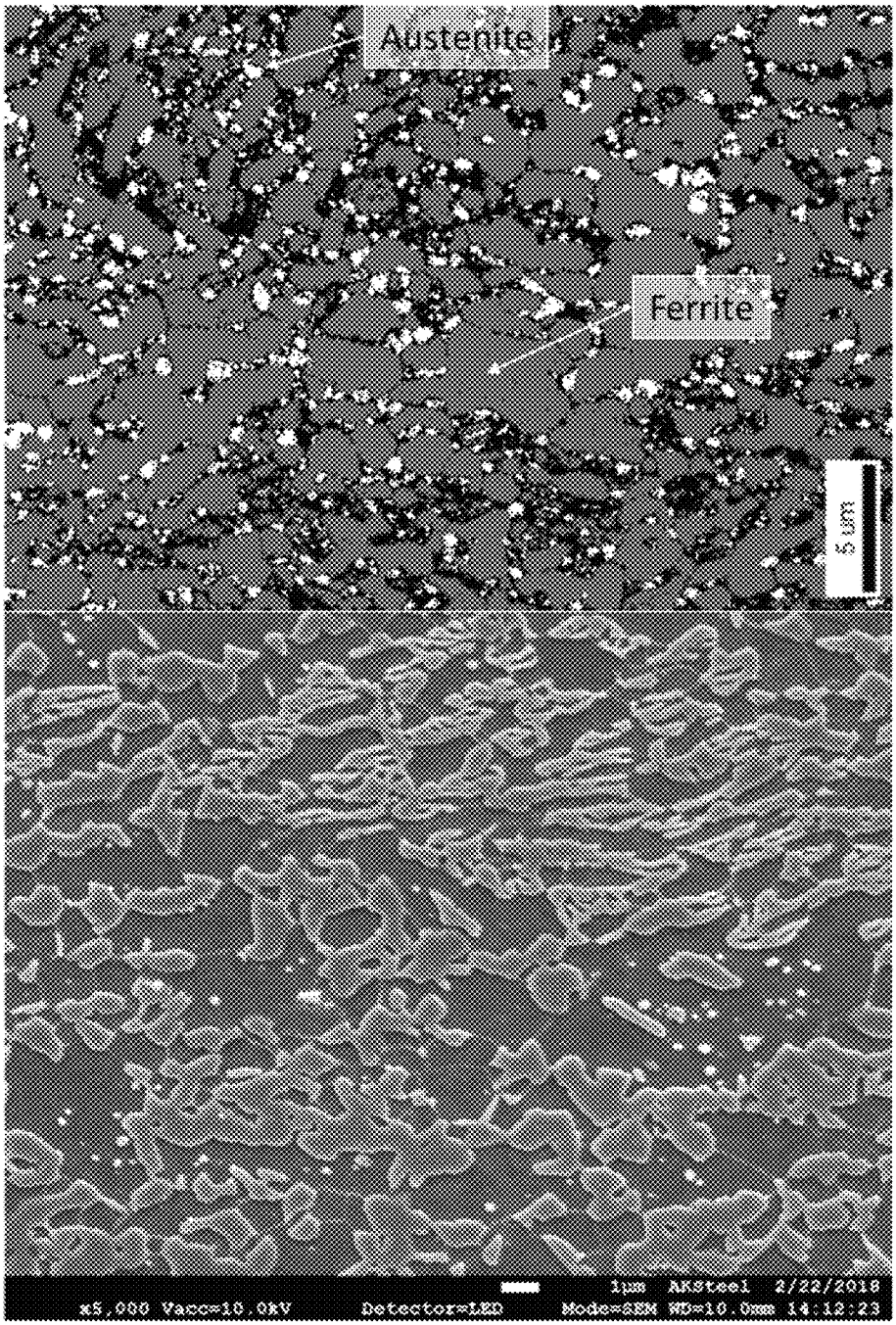
FIG. 4 depicts Scanning Electron Microscope images of Alloy 84 microstructures, hot band batch annealed, cold rolled and finished annealed.

The remarkable mechanical tensile properties exemplified by Alloy 84 are achieved by the resulting microstructure consisting of ferrite, austenite, and martensite. In the batch annealed hot band, cold rolled and finished steel, the microstructure contains a fine ferrite matrix with a considerable amount of retained austenite estimated between 15-35%. The microstructure is shown in FIG. 4, where the SEM-EBSD image shows the austenite as the smaller phase in green color. The top image FIG. 4 is an EBSD image where the austenite is identified by the white color, while the ferrite is gray color. The bottom image is a secondary electron image of the microstructure.

Figure 5:
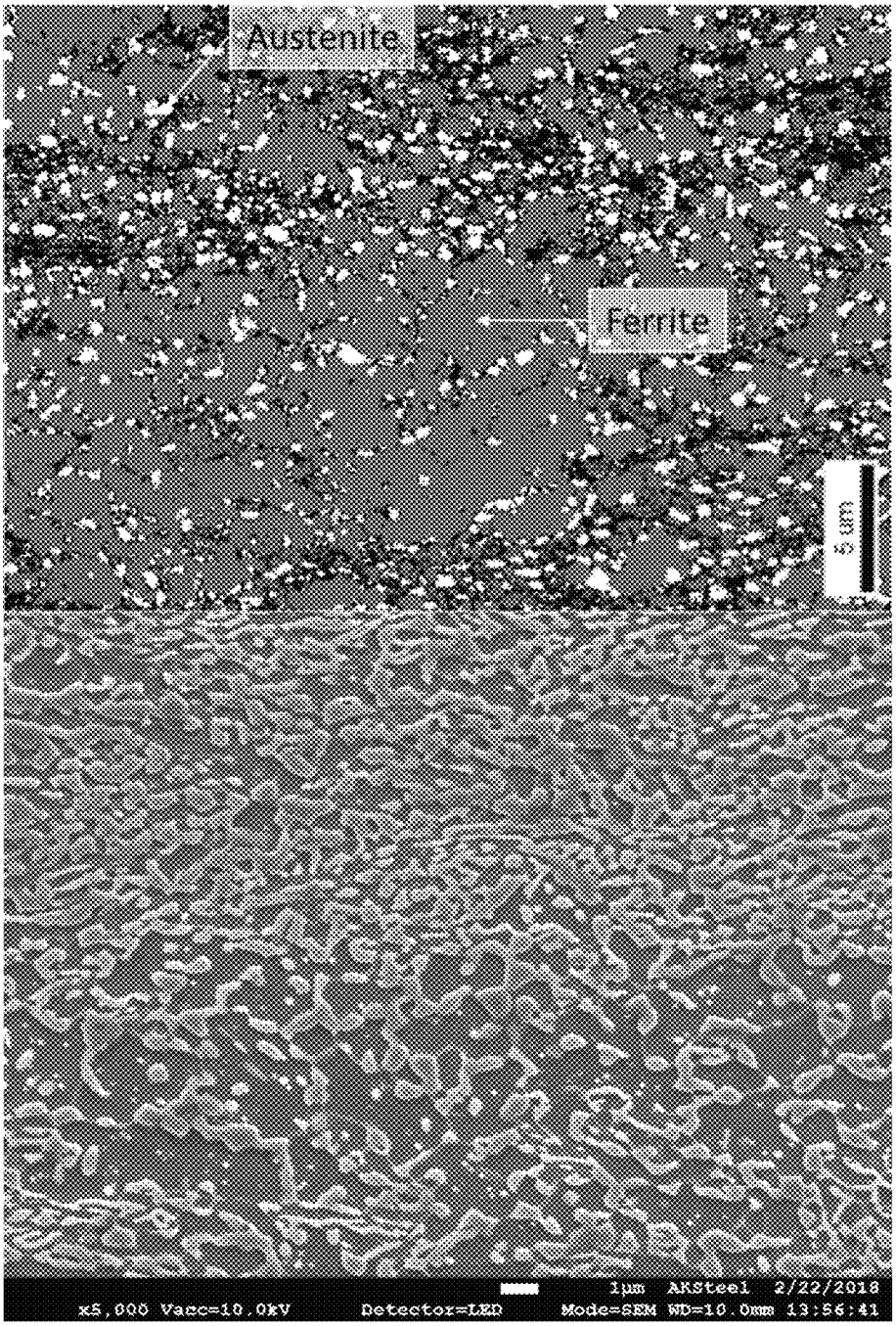
FIG. 5 depicts Scanning Electron Microscope images of Alloy 84 microstructures, hot band continuously annealed, cold rolled and finished annealed.

In the continuously annealed hot band, cold reduced, and finished steel, the microstructure is similar to the batch annealed hot band, but much finer. See FIG. 5. The top image is an EBSD image where the austenite is identified by the white color, while the darker gray color. The bottom image is a secondary electron image of the microstructure. Here the fine austenite, estimated to be between 15-50% of the overall microstructure, was responsible for the very high YS and TS.

Example 6

A steel comprises 0.20 to 0.30 wt % carbon, 3.0 to 5.0 wt % manganese, 0.5 to 2.5 wt % silicon, 0.5 to 2.0 wt % aluminum, 0-0.5 wt % molybdenum, 0-1.5 wt % nickel; 0-0.050 wt % niobium, 0-1.0 wt % chromium, and the balance being iron and impurities associated with steelmaking.

Example 7

The steel of one or more of Example 6 or any of the following examples further comprises 0.25 to 0.35 wt % molybdenum.

Example 8

The steel of one or more of Examples 6 or 7, or any of the following examples, further comprises 0.50 to 1.5 wt % nickel.

Example 9

The steel of one or more of Examples 6, 7, 8, or any of the following examples, further comprises 0.25 to 0.35 wt % molybdenum.

Example 10

The steel of one or more of Examples 6, 7, 8, 9, or any of the following examples, further comprises 0.70 to 1.2 wt % nickel.

Example 11

The steel of one or more of Examples 6, 7, 8, 9, 10, or any of the following examples, wherein Si+Al is 3 wt % or less.

Example 12

The steel of one or more of Examples 6, 7, 8, 9, 10, 11, or any of the following examples, further comprises 3.0 to 4.0 wt % manganese.

Example 13

The steel of one or more of Examples 6, 7, 8, 9, 10, 11, 12, or any of the following examples, further comprises 1.0 to 2.0 wt % silicon.

Example 14

The steel of one or more of Examples 6, 7, 8, 9, 10, 11, 12, 13, or any of the following examples, further comprises 1.0 to 1.5 wt % aluminum.

Example 15

The steel of one or more of Examples 6, 7, 8, 9, 10, 11, 12, 13, 14, or any of the following examples, further comprises 0 to 0.65 wt % chromium.

Example 16

The steel of one or more of Examples 6, 7, 8, 9, 10, 11, 12, 13, 14, 15, or any of the following examples, wherein a hot band comprised of the steel, has a Charpy V-notch impact testing energy above 20 J (14.7 ft-lbf) in a full size CVN specimens, or 1427 in-lbf/in^2 in a thinner hot band, as measured at room temperature.

Example 17

The steel of one or more of Examples 6, 7, 8, 9, 10, 11, 12, 13, 14, 15, 16, or any of the following examples, wherein the steel is intercritical annealed at a temperature of 700 to 800° C.

Example 18

The steel of one or more of Examples 6, 7, 8, 9, 10, 11, 12, 13, 14, 15, 16, 17, or any of the following examples, wherein the steel is intercritical annealed as a hot band.

Example 19

The steel of one or more of Examples 6, 7, 8, 9, 10, 11, 12, 13, 14, 15, 16, 17, 18, or any of the following examples, wherein the steel is intercritical annealed in a coating line.

Example 20

The steel of one or more of Examples 6, 7, 8, 9, 10, 11, 12, 13, 14, 15, 16, 17, 18, 19, or any of the following examples, wherein the steel is intercritical annealed in a hot dip coating line.

Example 21

The steel of one or more of Examples 6, 7, 8, 9, 10, 11, 12, 13, 14, 15, 16, 17, 18, 19, 20, or the following example, wherein the steel is intercritical annealed in a continuous annealing line.

Example 22

The steel of one or more of Examples 6, 7, 8, 9, 10, 11, 12, 13, 14, 15, 16, 17, 18, 19, 20, 21, wherein the steel is intercritical annealed in a batch annealing process.

What is claimed is:

1. A steel comprising 0.20 to 0.30 wt % carbon, 3.0 to 5.0 wt % manganese, 0.5 to 2.5 wt % silicon, 0.5 to 2.0 wt % aluminum, 0.25-0.5 wt % molybdenum, greater than 1.0% up to 1.5 wt % nickel; 0-0.050 wt % niobium, 0-1.0 wt % chromium, and the balance being iron and impurities associated with steelmaking, wherein the steel comprises 15-50% austenite by total area ratio, wherein a hot band comprised of the steel has a Charpy V-notch ("CVN") impact testing energy above 20 J (14.75 ft-lbf) in a full size CVN specimen or 0.25 J/mm$^2$ (1427 in-lbf/in^2) in a thinner hot band, as measured at room temperature.

2. The steel of claim 1 further comprising 0.25 to 0.35 wt % molybdenum.

3. The steel of claim 1 further comprising greater than 1.0% up to 1.2 wt % nickel.

4. The steel of claim 2 further comprising greater than 1.0% up to 1.2 wt % nickel.

5. The steel of claim 1 wherein Si+Al is 3 wt % or less.

6. The steel of claim 1 further comprising 3.0 to 4.0 wt % manganese.

7. The steel of claim 1 further comprising 1.0 to 2.0 wt % silicon.

8. The steel of claim 1 further comprising 1.0 to 1.5 wt % aluminum.

9. The steel of claim 1 further comprising 0 to 0.65 wt % chromium.

10. The steel of claim 1 wherein an as-cast slab comprised of the steel exhibits substantially no edge cracking at room temperature.

11. A process of making the steel of claim 1 wherein the steel is intercritical annealed at a temperature of 700 to 800° C.

12. The process of claim 11 wherein the steel is intercritical annealed as a hot band.

13. The process of claim 11 wherein the steel is intercritical annealed in a hot dip coating line.

14. The process of claim 11 wherein the steel is intercritical annealed in a continuous annealing line.

15. A steel comprising 0.20 to 0.30 wt % carbon, 3.0 to 5.0 wt % manganese, 0.5 to 2.5 wt % silicon, 0.5 to 2.0 wt % aluminum, 0.25-0.5 wt % molybdenum, 0.5-1.5 wt % nickel; 0-0.050 wt % niobium, 0-1.0 wt % chromium, and the balance being iron and impurities associated with steelmaking, wherein the steel comprises greater than 40% up to 50% austenite by total area ratio, wherein a hot band comprised of the steel has a Charpy V-notch ("CVN") impact testing energy above 20 J (14.75 ft-lbf) in a full size CVN specimen or 0.25 J/mm$^2$ (1427 in-lbf/in^2) in a thinner hot band, as measured at room temperature.

16. The steel of claim 15 further comprising greater than 1.0% up to 1.5 wt % nickel.

17. A process of making the steel of claim 15 wherein the steel is intercritical annealed at a temperature of 700 to 800° C.

* * * * *